US007815829B2

(12) United States Patent
Schuecker

(10) Patent No.: US 7,815,829 B2
(45) Date of Patent: Oct. 19, 2010

(54) PROCESS AND DEVICE FOR PRODUCING HORIZONTALLY TAMPED COAL CAKES

(75) Inventor: Franz-Josef Schuecker, Castrop-Rauxel (DE)

(73) Assignee: UHDE GmbH, Dortmund (DE)

( * ) Notice: Subject to any disclaimer, the term of this patent is extended or adjusted under 35 U.S.C. 154(b) by 671 days.

(21) Appl. No.: 11/667,866

(22) PCT Filed: Oct. 27, 2005

(86) PCT No.: PCT/EP2005/011493

§ 371 (c)(1),
(2), (4) Date: Oct. 17, 2007

(87) PCT Pub. No.: WO2006/056286

PCT Pub. Date: Jun. 1, 2006

(65) Prior Publication Data

US 2008/0087538 A1 Apr. 17, 2008

(30) Foreign Application Priority Data

Nov. 23, 2004 (DE) ..... 10 2004 056 564

(51) Int. Cl.
*B29C 47/00* (2006.01)

(52) U.S. Cl. ..... 264/148; 425/253; 425/575; 425/594

(58) Field of Classification Search ..... 264/148; 425/253–255, 574–575, 589, 594–595
See application file for complete search history.

(56) References Cited

U.S. PATENT DOCUMENTS 3,008,199 A * 11/1961 Jeppesen ..... 425/177
3,284,372 A * 11/1966 Bailey ..... 264/452
3,912,091 A 10/1975 Thompson
4,606,876 A * 8/1986 Yoshida et al. ..... 264/120
6,332,957 B1 12/2001 Gross et al.
7,147,452 B2 * 12/2006 Everett et al. ..... 425/354
7,311,865 B2 * 12/2007 Williamson ..... 264/148

FOREIGN PATENT DOCUMENTS

| | | | |
|---|---|---|---|
| DE | 557 178 | A | 8/1932 |
| DE | 31 45 344 | A1 | 5/1983 |
| DE | 32 36 967 | A1 | 4/1984 |
| DE | 35 33 071 | A1 | 8/1987 |
| DE | 39 10 214 | C1 | 5/1990 |
| DE | 195 45 736 | A1 | 6/1997 |
| DE | 198 03 455 | C1 | 8/1999 |
| DE | 198 07 484 | A1 | 9/1999 |
| JP | 57-90090 | A | 6/1982 |
| JP | 59-122581 | A | 7/1984 |
| SU | 1784628 | A1 | 12/1992 |

* cited by examiner

*Primary Examiner*—Richard Crispino
*Assistant Examiner*—Thu Khanh T Nguyen
(74) *Attorney, Agent, or Firm*—Marshall & Melhorn, LLC

(57) ABSTRACT

A process and device are disclosed for producing horizontally tamped coal cakes for coking in the oven chamber of a coking oven, the coal cakes being formed in a compression mold by stationary compression tools which work in the horizontal direction and with a stroke having a strictly limited length. The compression mold has a sliding stop wall which is moved away from the compression tools as the coal cake grows, under the effect of a suitable antagonistic braking force.

22 Claims, 2 Drawing Sheets

PROCESS AND DEVICE FOR PRODUCING HORIZONTALLY TAMPED COAL CAKES

BACKGROUND OF THE INVENTION

The invention relates to an apparatus and a process for the horizontal production of a pressed coal cake for the purpose of coking the coal cake in the oven chamber of a coke oven, fixed pressing tools being used which operate horizontally and with a closely limited stroke.

Devices and processes for the tamping of coal cakes have been state of the art for a long time, for instance as described in DE 557 178 and DE 31 45 344. According to the state of the art, the tamped coal cakes are produced in a manner such that the cake grows in an upward direction up to its full height.

DE 198 07 484 describes a tamping process for this purpose. In this process, linear motors are used to lift the tamping rods which are then allowed to drop onto the bulk coal. A similar process is also described in DE 35 33 071 or DE 39 10 214. This means that the design of such a tamping device has to ensure that the tamping rods are suitable for tamping intensely and uniformly not only an extremely flat coal cake but also a completely filled pressing chamber versus an almost finished tamped cake.

In commercial-scale coking plants, the tamped cakes and, consequently, the pressing chambers in which they are produced, are usually 4 m to 7 m high, the disadvantage of this being that an appropriate additional space has to be provided for the tamping rods above the pressing chambers. Moreover, the charging facilities have to be located above these pressing chambers and the entire bulk coal quantity has to be conveyed to a point above the pressing chambers in order that it can be charged into the pressing chambers.

It is further known in the state of the art that the tamping rods and, in particular, the base of the tamping rods obstruct the charging of the bulk coal. To this end, it is proposed in DE 31 45 344 that the bases be foldable so that they thus constitute a lesser obstacle for the coal charging. The disadvantage of such an arrangement is that the mechanically highly stressed tamping rod bases have to provided with articulated elements which are more prone to failure than a rigid arrangement and that they have to be maintained. In the above-mentioned document, the height of the tamped cakes is quoted as being 4-6 m.

For the production of low, i.e. horizontal, tamped coal cakes, such as are commonly used in so-called non-recovery coke ovens, DE 198 03 455 suggests that the cake be tamped in the known vertical press mould and the press mould be constructed as part of a tipping device in order to allow the cake to be brought into the horizontal position after its production. Such a device is highly complex.

U.S. Pat. No. 3,912,091 describes a device in which a horizontal tamped cake is produced. To do so, the coal is levelled in the chamber during the charging operation vertically from above and simultaneously compacted in the chamber. The operation of the sophisticated conveying and compacting facilities in the hot oven chamber is technically highly complex, because costly water cooling is required for the conveyer. In particular, the vibration caused by the compactor should be regarded critically, as this can conceivably result in damage to the brickwork. A further disadvantage is the fact that the levelling devices have to be mobile so that they can be moved above the tamped cake.

DE 195 45 736 likewise describes the production of a horizontal pressed coal cake, the bulk coal being charged into a so-called coal moulding box outside the oven and then compacted. The dimensions of the finished coal cake are quoted in DE 195 45 736 as being preferably 0.6 m high, 3-5 m wide and 10-20 m long. A method of compacting this horizontal coal cake is not described in this document.

It is thus the objective of the invention to rectify the disadvantages of the present state of the art and to provide a coal pressing device and a process that is more economical by virtue of its more compact construction and yet has the same or better pressing characteristics than the known tamping device and process.

BRIEF SUMMARY OF THE INVENTION

This objective is achieved by the invention in that a hydraulic pressing device is employed for the production of compacted coal cake from bulk coal for use in a coke oven, the hydraulic pressing device consisting of at least one hydraulic plunger, a mould, a removable cake carrier plate placed onto the bottom of the mould, and a delivery chute arranged above the mould, further characterised in that the mould is in the form of a carriage or cradle comprising side walls, a bottom and a stop plate, the delivery chute being arranged above the carriage or cradle perpendicularly to its movement direction, permanently fixed hydraulic cylinders which move a cylinder head piece in a horizontal direction and, while moving forward, the head piece forcing the coal delivered by the delivery chute perpendicularly to the delivery chute forward under the delivery chute against the stop plate and under a level pressed cake cover, the carriage being braked by a force acting in the opposite direction to the pressing direction, and the pressed cake cover, which is arranged immediately adjacent to the delivery chute, the cylinder head piece and the delivery chute being aligned in parallel.

In an advantageous embodiment of the invention, the cylinder head piece consists of a vertical pressure plate and a horizontal closure plate, the cylinder head piece not narrowing the outlet of the delivery chute in the rest position, the rest position being the first end position, and the closure plate of the cylinder head progressively narrowing the outlet of the delivery chute during the forward movement, and upon reaching the maximum stroke, i.e. the second end position, completely closing the delivery chute outlet.

In a further advantageous embodiment of the apparatus according to the present invention, the cylinder head piece is sub-divided perpendicularly to the forward movement direction into at least two sections.

Another variant of the apparatus according to the present invention constitutes an advantage in that the pressed cake cover only partly covers the press mould in the forward direction of the coal cake movement, its height is adjustable and it can be lifted, especially for the purpose of coal cake removal. In this case it is also an advantage if the pressed cake cover or its suspension is designed to permit variation of the bearing pressure upon the coal cake.

In a further optimised embodiment of the invention, the pressed cake cover plate is segmented in the direction of movement of the hydraulic cylinders, so that the bearing pressure of each segment can be individually varied.

In an optimised variant of the apparatus according to the invention, the braking force of the carriage- or cradle-type press mould is variable. It is thus possible, via the vertically and horizontally variable pressing force, to allow for different qualities of the bulk coal and to obtain an optimum shape of the coal cake.

Ideally, the hydraulic cylinder, delivery chute and pressed cake cover plate are arranged parallel to the narrow side of the carriage, so that the dimensions of these components can be made as small as possible.

The invention further encompasses a device which uses a flat trough as the press mould in the apparatus described above. The trough features a movable stop plate with a delivery chute arranged above, and parallel to, the stop plate, the hydraulic cylinders, which are permanently fixed and which move a cylinder head piece in the horizontal direction, and which, during the forward movement, force the coal from the delivery chute by means of the cylinder head piece perpendicularly to, and under, the delivery chute against the stop plate and under a level pressed cake cover, the stop plate being braked by a force acting in the opposite direction to the forward movement of the hydraulic cylinders, and the pressed cake cover, which is immediately adjacent to the delivery chute, the cylinder head piece and the delivery chute being aligned in parallel.

In an improved version of this device equipped with a trough, the cylinder head piece consists of a vertical pressure plate and a horizontal closure plate, the cylinder head piece not narrowing the outlet of the delivery chute in the rest position, this being the first end position, and the cylinder head piece, during its forward movement, progressively narrowing the outlet of the delivery chute until the outlet of the delivery chute is completely closed at the maximum stroke, i.e. the second end position.

In an optimised variant of the apparatus according to the invention, the braking force of the stop plate is variable.

It is advantageous to sub-divide the cylinder head piece perpendicularly to the forward movement direction into at least two sections.

In a further advantageous version of the apparatus according to the present invention, the pressed cake cover covers the trough only partly in the forward direction of coal cake movement. A further improvement permits the pressed cake cover to be adjusted in height and lifted, especially for the purpose of removing the coal cake and an additional improvement is the variability of the bearing pressure of the pressed cake cover plate.

A further improved embodiment of the invention provides for segmentation of the pressed cake cover plate in the forward movement direction of the hydraulic cylinders and for individual variability of the bearing pressure of each segment. In addition, it is generally advantageous to arrange the hydraulic cylinders, delivery chute and pressed cake cover plate in a manner as to minimise the dimensions.

The invention further comprises a process for the production of coal cake using one of the aforementioned hydraulic pressing devices, the press mould being in the form of a cradle, carriage or trough, characterised in that the coal cake is formed in a plurality of horizontal pressing steps and the bulk coal is compacted to a density which is 60% greater than the original density. In this process, the distance covered by the cylinder head or the pressure plate at the end of the cylinder head is essentially always the same, because the pressed coal cake is shifted towards the rear by the amount formed with or in the press mould.

BRIEF DESCRIPTION OF THE DRAWINGS

FIG. 1 is a sketch showing an example of the apparatus according to the present invention with the pressing device being in the form of a carriage, whereas

| Key | |
|---|---|
| 1 | Carriage |
| 2 | Bottom |
| 3 | Cake carrier plate |
| 4 | Stop plate |
| 5 | Roller |
| 6 | Delivery chute |
| 7 | Bulk coal |
| 8 | Hydraulic cylinder |
| 9 | Fixture |
| 10 | Pressure plate |
| 11 | Closure plate |
| 12 | Pressed cake cover |
| 13 | Pressed coal cake |
| 13a | Pre-pressed coal |
| 14 | Direction of braking force |
| 15 | Position line |
| 16 | Trough |
| 17 | Stop plate (movable) |
| 18 | Direction of pressing force |

DETAILED DESCRIPTION OF THE INVENTION

Figure 1:
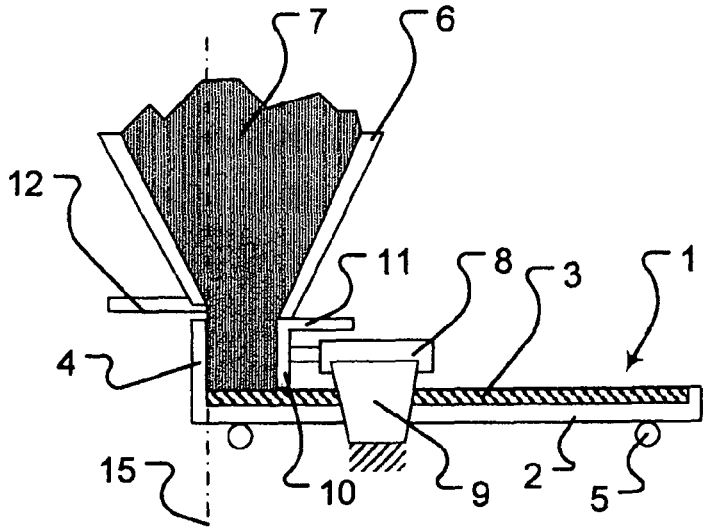
Figure 1:
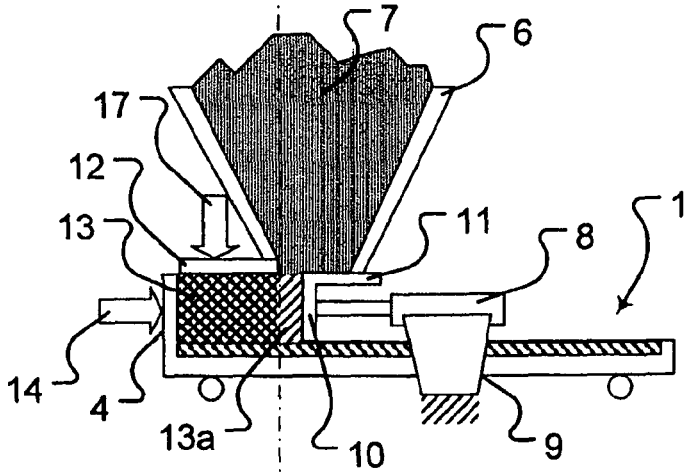
Figure 1:
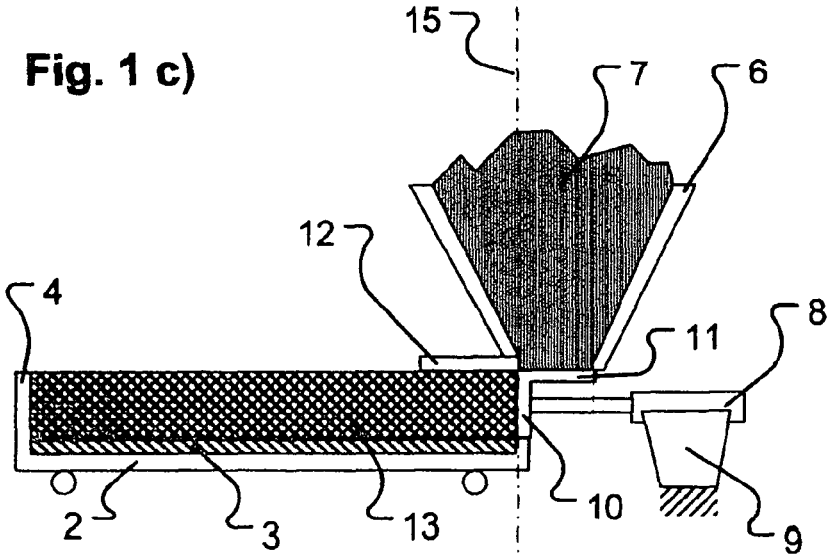

FIG. 1*a*) shows the press mould in the form of a carriage 1, basically consisting of the bottom 2, the placed removable cake carrier plate 3, the stop plate 4 arranged in front as seen in the movement direction, and the rollers 5 arranged beneath the bottom 2. The delivery chute 6, which contains the bulk coal 7 which, in turn, drops onto the carriage 1 or the cake carrier plate 3, is arranged above the carriage 1. FIG. 1*a*) further shows the hydraulic cylinder 8, which is attached to a fixture 9, and is oriented parallel to the delivery chute 6, and which spans the carriage 1, so that the latter moves under the fixture 9 and hydraulic cylinder 8.

The cylinder head piece of the hydraulic cylinder 8 shown in FIG. 1*a*) basically comprises a vertical pressure plate 10 and a horizontal closure plate 11 joined thereto. The pressed cake cover 12, which is shown in partly lifted state in FIG. 1*a*), thus permitting the stop plate 4 to be moved under it, is arranged above the carriage 1 and extends horizontally to the cake carrier plate 3. It can be seen that the bulk coal 7 drops onto the cake carrier plate 3 in the area between the pressure plate 10 of the hydraulic cylinder 8, which is shown in this figure in the retracted position, the stop plate 10 and under the delivery chute 6.

In FIG. 1*b*), the hydraulic cylinders 8 are partly extended, so that the closure plate 11 partly closes the outlet of the delivery chute 6. In addition, an area 13*a* can be seen immediately in front of the pressure plate, this area being shown hatched and containing the pre-pressed bulk coal. The pressed coal cake 13, which had formed during a plurality of pressing steps, takes shape between stop plate 4, pressed cake cover 12 and pressure plate 10 of the hydraulic cylinder 8. The direction of the pressing force of the pressed cake cover 12 is indicated by arrow 17.

To generate the pressing force upon the stop plate 4, the carriage 1 has to be braked. The direction of the braking force is indicated by arrow 14, the braking device itself not being illustrated because it can be designed in any way known to an expert versed in the art. In FIG. 1*b*), the carriage 1 has already been moved away from the starting position, which is indicated by a dashed position line 15, against the direction of the braking force and in the direction of the forward movement of the hydraulic cylinder 8.

FIG. 1*c*) shows the finished pressed coal cake 13, carriage 1 being likewise already in the end position. The cake carrier plate 3 with the pressed coal cake 13 is ready for removal.

Figure 2:
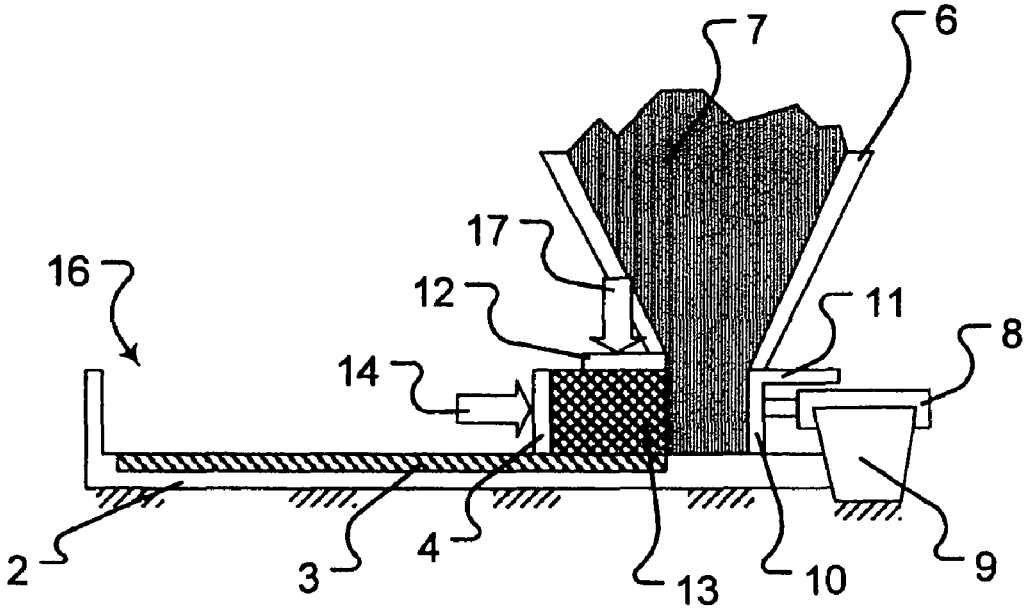
FIG. 2 shows the apparatus with the pressing device in the form of a trough.

FIG. 2 illustrates the apparatus according to the present invention, the press mould being in the form of a trough 16 and the bottom 2 being essentially immobile. The stop plate 4, which is not rigidly joined to the press mould is braked analogously to the aforementioned device, so that the required pressure for producing the pressed coal cake 13 is thereby generated. The pressed coal cake 13 is produced on the coal carrier plate 3 and likewise takes shape between stop plate 4, pressed cake cover 12 and pressure plate 10 of the hydraulic cylinder 8. The direction of the pressing force of the pressed cake cover 12 is indicated by arrow 17.

The invention claimed is:

1. A hydraulic pressing device for the production of compacted coal cake from bulk coal for use in a coke oven, the hydraulic pressing device comprising at least one hydraulic plunger, a mold, a removable cake carrier plate placed onto the bottom of the mold, a delivery chute arranged above the mold, wherein the mold is in the form of a carriage or cradle comprising side walls, a bottom and a stop plate, a delivery chute is arranged above the cradle or carriage perpendicularly to its movement direction, permanently fixed hydraulic cylinders which move a cylinder head piece in a horizontal direction with the head piece, while moving forward, forcing the coal delivered by the delivery chute perpendicularly to the delivery chute forward under the delivery chute against the stop plate and under a level pressed cake cover, the carriage is braked by a force acting in the opposite direction to the pressing direction of the hydraulic cylinders, and the pressed cake cover, which is arranged immediately adjacent to the delivery chute, the cylinder head piece and the delivery chute are aligned in parallel.

2. The apparatus according to claim 1, wherein the cylinder head piece comprises a vertical pressure plate and a horizontal closure plate, the cylinder head piece does not narrow the outlet of the delivery chute in the rest position, the rest position being the first end position, and the closure plate of the cylinder head progressively narrows the outlet of the delivery chute during the forward movement, and upon reaching the maximum stroke, i.e. the second end position, completely closing the delivery chute outlet.

3. The apparatus according to claim 1, wherein the cylinder head piece is sub-divided perpendicularly to the forward movement direction into at least two sections.

4. The apparatus according to claim 1, wherein the pressed cake cover only partly covers the press mold in the forward direction of the coal cake movement.

5. The apparatus according to claim 1, wherein the height of the pressed cake cover is adjustable and can be lifted, especially for the purpose of coal cake removal.

6. The apparatus according to claim 1, wherein the braking force of the carriage is variable.

7. The apparatus according to claim 1, wherein the bearing pressure of the pressed coal cake cover plate is variable.

8. The apparatus according to claim 7, wherein the pressed cake cover plate is segmented in the direction of movement of the hydraulic cylinders, and the bearing pressure of each segment can be individually varied.

9. The apparatus according to claim 1, wherein the hydraulic cylinder, delivery chute and pressed cake cover plate are arranged parallel to the narrow side of the carriage.

10. A hydraulic pressing device for the production of compacted coal cake from bulk coal for use in a coke oven, the hydraulic pressing device comprising at least one hydraulic plunger, a mold, a removable cake carrier plate placed onto the bottom of the mold, a delivery chute arranged above the mold, wherein the mold is in the form of a flat trough containing a movable stop plate, a delivery chute is arranged above and parallel to the stop plate, permanently fixed hydraulic cylinders which move a cylinder head piece in the horizontal direction with the head piece, while moving forward, forcing the coal delivered by the delivery chute perpendicularly to the delivery chute forward under the delivery chute against the stop plate and under a level pressed cake cover, the stop plate is braked by a force acting in the opposite direction to that of the hydraulic cylinders, and the pressed cake cover, which is arranged immediately adjacent to the delivery chute, the cylinder head piece and the delivery chute are aligned in parallel.

11. The apparatus according to claim 10, wherein the cylinder head piece comprises a vertical pressure plate and a horizontal closure plate, the cylinder head piece does not narrow the outlet of the delivery chute in the rest position, the rest position being the first end position, and the closure plate of the cylinder head progressively narrows the outlet of the delivery chute during the forward movement, and upon reaching the maximum stroke, i.e. the second end position, completely closing the delivery chute outlet.

12. The apparatus according to claim 10, wherein the cylinder head piece is sub-divided perpendicularly to the forward movement direction into at least two sections.

13. The apparatus according to claim 10, wherein the pressed cake cover only partly covers the trough in the forward direction of the coal cake movement.

14. The apparatus according to claim 10, wherein the height of the pressed cake cover is adjustable and can be lifted, especially for the purpose of coal cake removal.

15. The apparatus according to claim 10, wherein the braking force of the stop plate is variable.

16. The apparatus according to claim 10, wherein the bearing pressure of the pressed coal cake cover plate is variable.

17. The apparatus according to claim 16, wherein the pressed cake cover plate is segmented in the direction of movement of the hydraulic cylinders, and the bearing pressure of each segment can be individually varied.

18. The apparatus according to claim 10, wherein the hydraulic cylinder, delivery chute and pressed cake cover plate are arranged parallel to the narrow side of the trough.

19. A process for the production of coal cake using the apparatus according to claim 1, comprising forming the coal cake in a plurality of horizontal pressing steps and compacting the bulk coal to a density which is 60% greater than the original density.

20. A process for the production of coal cake using the apparatus according to claim 10, comprising forming the coal cake in a plurality of horizontal pressing steps and compacting the bulk coal to a density which is 60% greater than the original density.

21. A process for the production of coal cake using the apparatus according to claim 19, wherein the length of the horizontal stroke of the hydraulic cylinder is fixed and invariable.

22. A process for the production of coal cake using the apparatus according to claim 20, wherein the length of the horizontal stroke of the hydraulic cylinder is fixed and invariable.

* * * * *